US007230527B2

(12) United States Patent
Basu et al.

(10) Patent No.: US 7,230,527 B2
(45) Date of Patent: Jun. 12, 2007

(54) SYSTEM, METHOD, AND COMPUTER PROGRAM PRODUCT FOR FAULT PREDICTION IN VEHICLE MONITORING AND REPORTING SYSTEM

(75) Inventors: Sabyasachi Basu, Redmond, WA (US); William R. Frans, Seattle, WA (US); Roman D. Fresnedo, Kent, WA (US); Shuguang Song, Seattle, WA (US); Valeria V. Thompson, Seattle, WA (US); Rodney A. Tjoelker, Bellevue, WA (US); Virginia L. Wheway, Hamilton (AU); Ranjan K. Paul, Sammamish, WA (US); John B. Maggiore, Seattle, WA (US)

(73) Assignee: The Boeing Company, Chicago, IL (US)

( * ) Notice: Subject to any disclaimer, the term of this patent is extended or adjusted under 35 U.S.C. 154(b) by 337 days.

(21) Appl. No.: 10/985,601

(22) Filed: Nov. 10, 2004

(65) Prior Publication Data

US 2006/0097854 A1 May 11, 2006

(51) Int. Cl.
*G08B 29/00* (2006.01)

(52) U.S. Cl. ..... 340/506

(58) Field of Classification Search ..... 340/345.2, 340/506, 2.43; 700/83, 17, 525; 701/1, 701/99, 29–30, 33, 35
See application file for complete search history.

(56) References Cited

U.S. PATENT DOCUMENTS 4,943,919 A 7/1990 Aslin et al.
5,522,026 A 5/1996 Records et al.
5,566,092 A 10/1996 Wang et al.
5,931,877 A 8/1999 Smith et al.
5,953,707 A 9/1999 Huang et al.
5,974,349 A 10/1999 Levine
6,003,808 A 12/1999 Nguyen et al.
6,043,757 A 3/2000 Patrick (Continued)

FOREIGN PATENT DOCUMENTS

EP 1106504 A2 6/2001

(Continued)

OTHER PUBLICATIONS

U.S. Appl. No. 09/451,435, filed Nov. 2001, Butz.*

(Continued)

*Primary Examiner*—Jeffery Hofsass
*Assistant Examiner*—Shirley Lu
(74) *Attorney, Agent, or Firm*—Alston & Bird LLP

(57) ABSTRACT

A system, method, and computer program product for predicting failure of a vehicle system or subsystem by using statistical analysis of prior maintenance messages and vehicle failures, such that the predictions of failures may be incorporated into a vehicle monitoring and reporting system. Maintenance message data and vehicle system or subsystem failure data are collected from a central maintenance computer of a vehicle, such as an aircraft. This maintenance message and vehicle system or subsystem failure data are analyzed to discern relationships between maintenance messages and vehicle system or subsystem failures which will enable future failures to be predicted. By predicting future failures, maintenance can be performed in time to prevent the vehicle failure and thereby avoid unnecessary costs and unscheduled interruptions of vehicle operations.

41 Claims, 8 Drawing Sheets

U.S. PATENT DOCUMENTS

| | | | |
|---|---|---|---|
| 6,198,996 | B1 | 3/2001 | Berstis |
| 6,219,626 | B1 | 4/2001 | Steinmetz et al. |
| 6,292,724 | B1 | 9/2001 | Apsell et al. |
| 6,301,531 | B1 | 10/2001 | Pierro et al. |
| 6,338,152 | B1 | 1/2002 | Fera et al. |
| 6,370,454 | B1 | 4/2002 | Moore |
| 6,434,512 | B1 | 8/2002 | Discenzo |
| 6,442,459 | B1 | 8/2002 | Sinex |
| 6,459,969 | B1 | 10/2002 | Bates et al. |
| 6,553,290 | B1 | 4/2003 | Pillar |
| 6,631,384 | B1 | 10/2003 | Richman et al. |
| 2001/0033225 | A1 | 10/2001 | Razavi et al. |
| 2002/0065698 | A1 | 5/2002 | Schick et al. |
| 2002/0143443 | A1 | 10/2002 | Betters et al. |
| 2002/0143445 | A1 | 10/2002 | Sinex |
| 2002/0163427 | A1 | 11/2002 | Eryurek et al. |
| 2004/0158367 | A1 | 8/2004 | Basu et al. |

FOREIGN PATENT DOCUMENTS

| | | | |
|---|---|---|---|
| EP | 1445721 | A2 | 8/2004 |
| EP | 1445721 | A3 | 8/2004 |
| WO | WO 99/45519 | | 9/1999 |
| WO | WO 01/015001 | A2 | 3/2001 |
| WO | WO 01/15001 | A3 | 3/2001 |
| WO | WO02/17184 | | 2/2002 |

OTHER PUBLICATIONS

International Search Report for PCT/US2005/039722, dated Jul. 20, 2006.

Drew Dowling, Richard A. Lancaster, "Remote Maintenance Monitoring Using a Digital Data Link," American Institute of Aeronautics and Astronautics, 1984, pp. 503-507.

Christian Fremont, "Simplifying and Optimising Aircraft maintenance," AIRMAN 2000, Dec. 2001, pp. 2-7, FAST/No. 29.

Marc Virilli, "A330/A340 Central Maintenance System," Apr. 1994, pp. 2-9, FAST/No. 16.

Frederique Rigal, "A330/A340 Central Maintenance System Option Package Simplifying Mantenance," May 1997, pp. 8-14, FAST/No. 21.

"Airline Use of Engine Condition Monitoring," SAE/SAS Symposium/Workshop, Sep. 26-27, 1995, (Selected Pages-8 pages).

* cited by examiner

Fig. 6

| | Col. A | Col. B | Col. C | Col. D |
|---|---|---|---|---|
| | $\left(\frac{M(b/w)}{M(t)}\right) - \left(\frac{M(a)}{M(t)}\right)$ | $\left(\frac{M(b/wo)}{M(t)}\right) - \left(\frac{M(a)}{M(t)}\right)$ | $\left(\frac{M(b/w)}{F(t)}\right) - \left(\frac{M(a)}{F(t)}\right)$ | $\left(\frac{M(b/wo)}{F(t)}\right) - \left(\frac{M(a)}{F(t)}\right)$ |
| Potentially Significant MMSG-FDE Pair 1 | | | | |
| Potentially Significant MMSG-FDE Pair 2 | | | | |
| Potentially Significant MMSG-FDE Pair 3 | | | | |
| . | | | | |
| . | | | | |
| . | | | | |
| Potentially Significant MMSG-FDE Pair n | | | | |

SYSTEM, METHOD, AND COMPUTER PROGRAM PRODUCT FOR FAULT PREDICTION IN VEHICLE MONITORING AND REPORTING SYSTEM

CROSS-REFERENCE TO RELATED APPLICATIONS

The contents of U.S. patent application Ser. No. 10/360,295 entitled "Vehicle Monitoring and Reporting System and Method" by Basu et al., filed Feb. 7, 2003 and published Aug. 12, 2004 as U.S. Patent Application Publication No. 2004/0158367, are incorporated by reference in their entirety.

FIELD OF THE INVENTION

The present invention relates generally to the automated monitoring and reporting of vehicle performance data, and more particularly, to methods of predicting failures of vehicle subsystems by statistical analysis of prior maintenance messages and subsystem failures.

BACKGROUND OF THE INVENTION

Vehicles, particularly commercial air, marine and land vehicles, typically include some type of performance monitoring system that records data regarding the vehicle performance, which includes the performance of the various systems and subsystems of the vehicle. The data include a record of certain performance events that occur during the operation of the vehicle. The performance monitoring system typically conducts data collection and reports all of the data collected to the user. The user then may utilize the data in determining the type of maintenance, if any, that the vehicle may need. For example, if the data indicate that a particular component of the vehicle is malfunctioning or that the performance of one or more components may contribute to a vehicle failure in the future, then the user can perform the appropriate maintenance on the vehicle at the next opportunity.

For example, an air vehicle typically has a central maintenance computer (CMC). The CMC collects, consolidates and reports performance data for the components of the air vehicle. Certain maintenance messages (MMSGs) are associated with one or more types of performance data, and are stored in the CMC. Thus, when the CMC receives performance data, it analyzes the data to determine if the received data meets the criteria associated with the maintenance messages. If the received data meet the criteria, then the CMC presents the appropriate stored maintenance message to the user via a user interface. A CMC is further described, for example, in U.S. Pat. No. 4,943,919 entitled, "Central Maintenance Computer System and Fault Data Handling Method."

Certain events on an aircraft trigger Flight Deck Effects (FDEs). FDEs result when a system or subsystem failure, or other fault, causes a problem with the aircraft that may affect airworthiness. In addition to the maintenance messages collected by the CMC, as discussed above, information regarding FDEs are also collected by the CMC. Unlike maintenance messages, which are only viewed by maintenance personnel, FDEs are broadcast to the flight deck of the air vehicle to alert the flight crew. Some FDEs require immediate action by the flight crew to remedy the problem, such as returning to the origin airport (this is called an air turn-back) or diverting the flight to a different airport than the original destination (this is called a diversion) so the problem can be fixed. Some FDEs do not affect the current flight on which the FDE occurs, but rather require immediate maintenance at the destination airport. This need for immediate maintenance can therefore cause a delay or a cancellation of the next flight that the vehicle was scheduled to make. Some FDEs do not require in-flight action or immediate maintenance, but rather may merely require maintenance within a few days of the FDE first occurring. Whether an FDE requires immediate or delayed maintenance is typically dictated by the airline's Minimum Equipment List (MEL). An MEL permits operation of an aircraft under specified conditions with inoperative equipment. An MEL applies to an airline's particular aircraft configuration, operational procedures, and conditions. Whether an aircraft can operate, and for how long, with an FDE is described as MEL dispatch relief. For example, an FDE that requires immediate maintenance (i.e., the aircraft cannot fly again until the FDE is resolved) is described as having no MEL dispatch relief. Other FDEs may have varying levels of MEL dispatch relief.

While the current system(s) utilized for vehicle performance and fault monitoring provide the necessary data for a user to make an appropriate maintenance decision, it is still necessary for a user to sort through all of the data and maintenance messages to determine what type of maintenance is necessary. Thus, the user must sort and interpret the data provided by the monitoring system, such as the CMC for an air vehicle, in light of the user's knowledge of the particular maintenance plan for the vehicle. For example, one user may implement a conservative maintenance plan for its vehicles, and as such, that user may carry out a certain type of maintenance the first time a particular performance or fault event occurs during the operation of the vehicle. Another user, however, may wish to carry out a certain type of maintenance only if a particular performance or fault event occurs more than five times over a particular interval.

With the current monitoring systems, each user will be presented with the same performance and fault data, and the user must interpret it in light of their preferred maintenance plan, which is time consuming and dependent upon the user being familiar with the appropriate maintenance plan and any recent changes to the maintenance plan. For many types of vehicles, particularly commercial vehicles, the amount of time the vehicle is out of service is costly to the vehicle owner. As such, the longer it takes for a user to determine the type of maintenance that is necessary for a vehicle in accordance with the particular maintenance plan for the vehicle, the longer the vehicle will be out of service, which may be expensive to the vehicle owner if the vehicle would otherwise be in service.

Other monitoring systems include certain user customizable settings. For instance, some systems permit a user to specify alarm filtering and prioritization, and general alarm level triggers and thresholds. Thus, the data presented to the user will be associated with an alarm only if the data meet the criteria specified by the system. One example of such a system is disclosed in U.S. Patent Application Publication No. 2002/0163427 to Eryurek et al., which was published on Nov. 7, 2002. Further systems permit management of maintenance tasks based upon operational and scheduling preferences, such that the intervals between maintenance tasks may be increased or the tasks may be organized into groups. Examples of these systems are described in U.S. Pat. No. 6,442,459 to Sinex and U.S. Patent Application Publication No. 2002/0143445 to Sinex, which was published on Oct. 3, 2002. While these systems permit users to customize a performance monitoring system to some extent, they do not provide for the level of customization that is necessary to allow a user to implement a particular maintenance program based upon the user preferences. As such, although a user may be permitted to specify when and how alarms associated with the data are presented and/or when and how the user is notified of certain maintenance tasks in general, the systems do not allow a user to specify how the system interprets and presents particular type(s) of data. For example, the conventional monitoring systems would not permit a user to specify the number of times a particular performance event must occur during the operation of the vehicle before the user is notified that a particular type of maintenance is recommended.

One monitoring system which addresses many of the problems mentioned above is the system disclosed in co-pending U.S. Patent Application Publication No. 2004/0158367 entitled "Vehicle Monitoring and Reporting System and Method" by Basu et al., and published Aug. 12, 2004, which is incorporated herein by reference in its entirety. This monitoring system permits a user to implement a maintenance plan that fits a specific business plan for their vehicles by combining real-time vehicle performance data with specific user preferences for each potential type of data that is captured by the system. This system saves time and costs that are normally associated with a user interpreting all of the data provided by a vehicle monitoring and reporting system in light of a preferred maintenance plan, which is time consuming and dependent upon the user being familiar with the appropriate maintenance plan and any recent changes to the maintenance plan.

Current performance monitoring systems typically conduct data collection and report all of the data collected to the user. The user then may utilize the data in determining the type of maintenance that the vehicle may need. However, current systems can only wait for an FDE to occur, and then facilitate the appropriate maintenance to correct the FDE by utilizing the maintenance messages. Current systems do not allow for FDEs to be predicted and therefore avoided. If it were possible to discern a predictive relationship between the maintenance message data and the occurrence of FDEs, it may be possible to prevent FDEs by performing maintenance before the failure occurs. For example, if the maintenance message data indicate that one or more subsystems may fail in the near future, then the user can perform the appropriate maintenance on the vehicle at the next opportunity. The appropriate maintenance may include repair or replacement of the subsystem that is predicted to fail. Without the ability to predict subsystem failure, repair or replacement is not conducted until failure occurs. Waiting until failure occurs, particularly when the vehicle is an air vehicle, risks costly delays and cancellations in the scheduled use of the vehicle as well as other more serious consequences such as air turn-backs and diversions.

The system disclosed in U.S. Patent Application Publication No. 2004/0158367 by Basu et al. receives data, which may be fault data and/or prognostic data, associated with operation of the vehicle, via a data gathering element. In addition, at least one user preference may be applied to the data, such as via a customization element, and at least a portion of the data may be presented, such as via a display element. The data gathering element may be located within the vehicle and the customization element may be located outside the vehicle, with a communication link between the two elements to transmit data between the data gathering element and the customization element. In other embodiments, the data gathering element may be located outside the vehicle, and a communication link between the data gathering element and the vehicle may be utilized to transmit data between the vehicle and the data gathering element. In further embodiments, the data gathering element and the customization element may be integrated.

In some embodiments of this system, the data may represent events associated with operation of the vehicle, and an alerting preference may be applied to alert the user once the data reflect that a maximum number of events have occurred. The data also may be consolidated and the probability of vehicle failure from the occurrence of an event over time may be determined, such as by a processing element. In addition, a prioritization preference may be applied to prioritize the data based upon a probability of vehicle failure after the occurrence of an event, where data associated with a higher probability of vehicle failure has a higher priority than data associated with a lower probability of vehicle failure. Prioritization preferences also may include directions for presenting data based upon the priority of the data. In this embodiment, the alerting preferences may include directions to alert the user, and the data delivery preferences may include directions to immediately deliver the data to the user when the probability of vehicle failure after the occurrence of an event in the data is at least a predetermined value.

U.S. Patent Application Publication No. 2004/0158367 by Basu et al. discloses a system whereby the probability of vehicle failure from the occurrence of an event over time may be determined. However, repairing or replacing subsystems based on predictions of future failure, as this system does, requires the ability to accurately predict failure. Without accurate predictions, subsystems are replaced sooner than necessary or subsystems that were not likely to fail are replaced. In either event, inaccurate predictions of failure needlessly increase maintenance costs. Alternatively, without accurate predictions of failure, a vehicle operator cannot prevent failure by performing maintenance before the failure occurs. This results in costly unscheduled interruptions. By accurately predicting when a subsystem may fail, the appropriate maintenance can be scheduled so as to minimize or eliminate delays, while also minimizing premature or unnecessary replacement of subsystems.

As such, there is a need for a system, method, and computer program product for predicting future failure of vehicle subsystems incorporated into vehicle monitoring and reporting systems such as the one disclosed by U.S. Patent Application Publication No. 2004/0158367 by Basu et al.

BRIEF SUMMARY OF THE INVENTION

A system, method, and computer program product for predicting future failure of vehicle subsystems is therefore provided which uses statistical analysis of prior maintenance messages and vehicle system or subsystem failure occurrences to predict future failures, such that the predictions of future failures may be incorporated into a vehicle monitoring and reporting system. The vehicle monitoring and reporting system may therefore avoid replacing subsystems sooner than necessary, while still replacing the subsystems prior to failure. As such, maintenance costs may not be unnecessarily increased and maintenance may be scheduled in an orderly fashion so as to minimize or eliminate delays.

While embodiments of the present invention will be described in terms of a commercial aircraft monitoring and reporting system, it should be appreciated that the present invention may be used in a monitoring and reporting system for any type of commercial vehicle, and indeed for any vehicle utilizing a monitoring and reporting system.

In one embodiment of the present invention, the system for predicting faults in a vehicle system or subsystem which affect the operation of a vehicle begins by receiving maintenance message data and fault message data associated with operation of the vehicle. The maintenance message data comprise a number of maintenance messages and the fault message data comprise a number of fault messages. The maintenance message data and the fault data may be scrubbed to eliminate bad data. Bad data typically result from test flights, where test pilots purposely induce faults in the aircraft for testing purposes.

The system may then determine which of the maintenance messages are potentially predictive of fault messages. This may be determined by identifying which of the maintenance messages occur near a respective fault message, which in this context means the maintenance message occurs within a predefined number of flights from the respective fault message. This temporal relationship establishes the possibility that there may be a predictive relationship between a maintenance message and a fault message.

The system may then determine which of the potentially predictive relationships are actually predictive. This may be done by analyzing the potentially predictive relationships using ratios and ranking statistics. For example, the number of times the maintenance message occurs near the fault message can be divided by the total number of occurrences of the maintenance message. The higher this ratio is the more likely the maintenance message is predictive of the fault message. A ratio threshold may be predefined such that any potentially predictive relationships where the ratio is below the predefined threshold may be eliminated. Additionally, the ratio may be ranked highest to lowest, and a rank threshold may be predefined such that those potentially predictive relationships having a lower (i.e. worse) rank may be eliminated.

In addition to calculating the ratio of the number of times the maintenance message occurs near the fault message to the total number of occurrences of the maintenance message, actually predictive relationships may be determined by calculating the ratio of the number of times the maintenance message occurs near the fault message to the total number of occurrences of the fault message. This ratio may also be compared to a predefined ratio threshold such that any potentially predictive relationships where the ratio is below the predefined threshold may be eliminated. Again, this ratio may also be ranked highest to lowest, and a rank threshold may be predefined such that those potentially predictive relationships having a lower (i.e. worse) rank may be eliminated.

The remaining relationships that exceed the ratio and rank thresholds are likely predictive. In one embodiment of the invention, these predictive relationships may be provided to a vehicle monitoring and reporting system to allow failures to be predicted and maintenance performed to prevent the failures before they occur. Alternatively, these relationships may be determined within a vehicle monitoring and reporting system rather than in an external system.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 5(*b*) is a timeline illustrating the identification of MMSGs that occur before and without an FDE string;

FIG. 5(*c*) is a timeline illustrating the identification of MMSGs that occur after an FDE string;

FIG. 6 is a table illustrating the calculations required to rank potentially significant MMSG-FDE pairs;

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
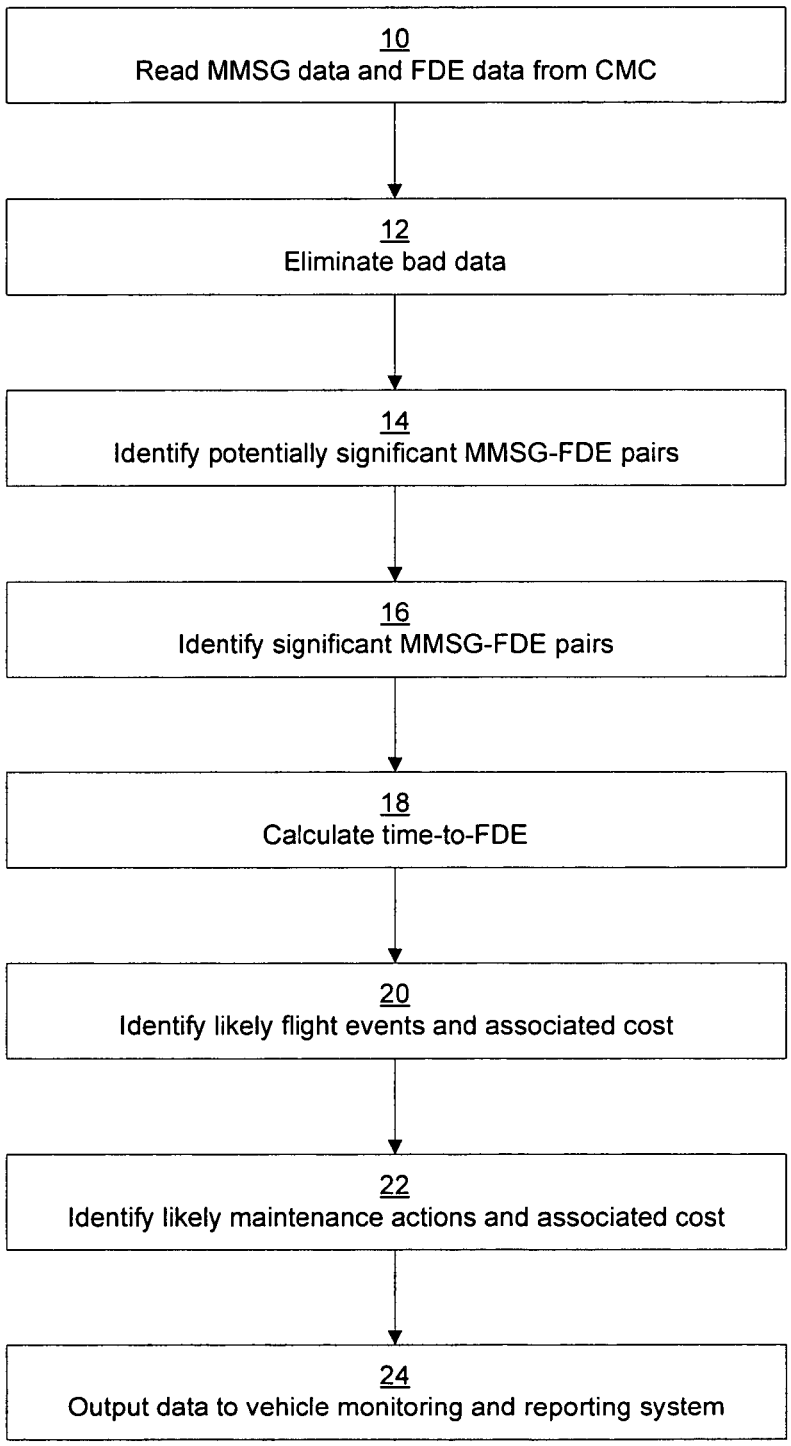
FIG. 1 is a flowchart of the operation a fault prediction system for a vehicle monitoring and reporting system.

FIG. 1 provides an overview of the operation of a fault prediction system according to one embodiment of the present invention. While embodiments of the present invention will be described in terms of a commercial aircraft monitoring and reporting system, it should be appreciated that the present invention may be used in a monitoring and reporting system for any type of commercial vehicle, and indeed for any vehicle utilizing a monitoring and reporting system.

As shown in step 10 of FIG. 1, maintenance message data and vehicle system or subsystem failure data are collected, such as from a central maintenance computer (CMC) of a vehicle, for example, an aircraft. The vehicle system or subsystem failure may be a flight deck effect (FDE), as discussed above, which is a failure affecting airworthiness of the aircraft. Vehicle system or subsystem failures which do not affect the airworthiness of the aircraft, and therefore are not FDEs, do not need to be repaired as quickly as FDEs and can typically be repaired during the next scheduled maintenance of the aircraft. The maintenance message data and the vehicle system or subsystem failure data are all associated with a unique identifier of the particular vehicle operation during which the MMSG and/or FDE arose. For aircraft operations, the unique identifier is a unique flight identifier, which includes information about the specific aircraft involved (such as by tail number or aircraft serial number), the type of aircraft (such as Boeing 777), the date and time of the flight, and the origin and destination airports. This maintenance message and vehicle system or subsystem failure data are analyzed to discern relationships between maintenance messages and failures, such as FDEs, which will enable future failures to be predicted.

After the maintenance message and FDE data are collected, the data may be scrubbed to eliminate bad data, as shown in step 12 of FIG. 1. Bad data may, for example, result from test flights and may also result when the airline does not routinely and completely download the data from the CMC. Test flight data may be identified by several methods.

Figure 2:
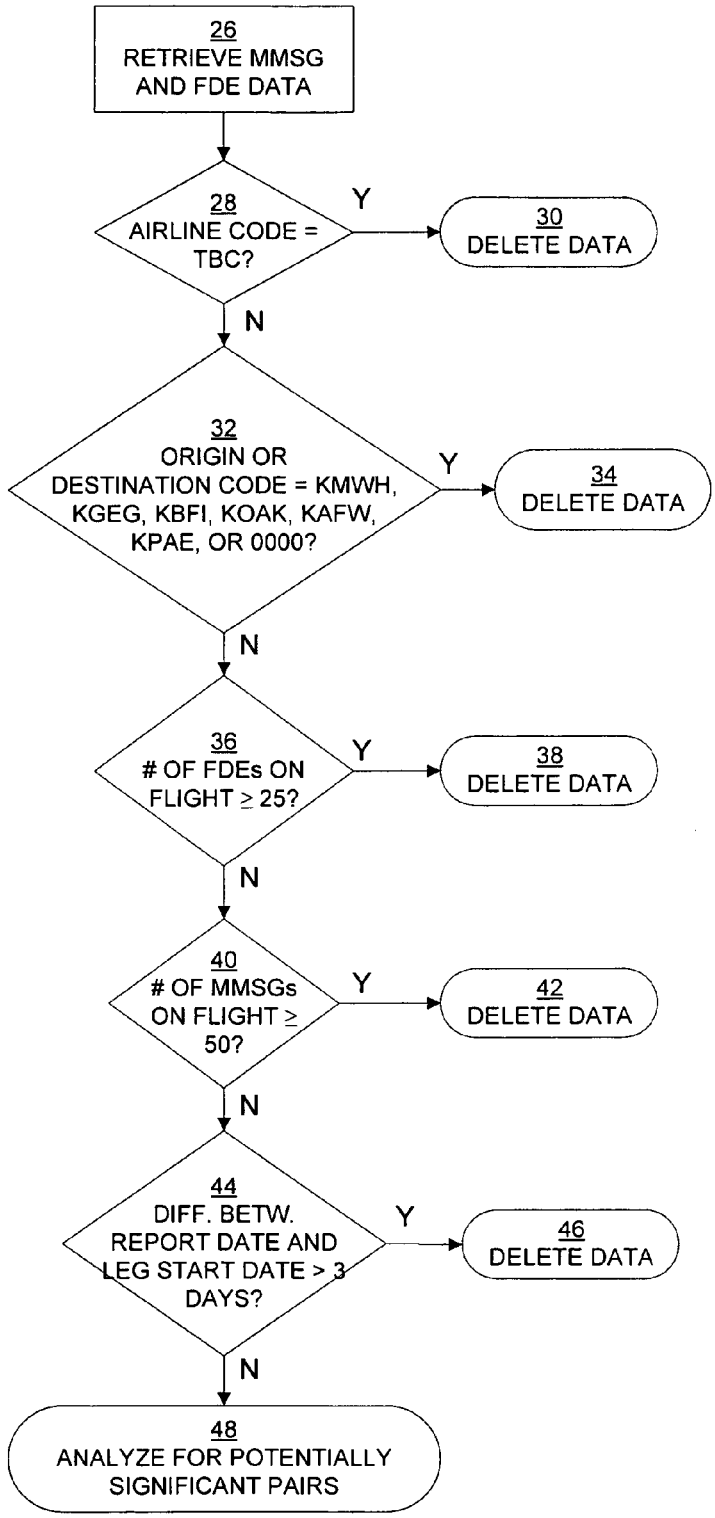
FIG. 2 is a flowchart illustrating the process of identifying bad data in the MMSG and FDE data.

One exemplary process of identifying bad MMSG and FDE data, including test flight data, is depicted in FIG. 2. In this regard, a special airline code is used on test flights indicating the flight was conducted by the airplane manufacturer. For example, as shown in step 28, the airline code may be TBC, which designates The Boeing Company. This code is indicative of a test flight, and therefore the data that are collected in step 26 that has a test flight code as shown in step 28 may be deleted as in step 30. Certain airport codes can also indicate test flights where the flight origin or destination was an airport that is used mainly for test flights. There are a number of these airports shown in step 32 as being represented by an origin or a destination code of KMWH, KGEG, KBFI, KOAK, KAFW, KPAE, or 0000. Where either the origin or the destination is one of these airports, the data for that flight may be deleted as in step 34. A large number of MMSGs (for example, greater than fifty) or FDEs (for example, greater than twenty-five) on a single flight generally indicate actions by a test flight crew to purposely induce faults. If more than twenty-five FDEs occur on a single flight, as shown in step 36, then the data for that flight may be deleted as in step 38. If more than fifty MMSGs occur on a single flight, as shown in step 40, then the data for that flight may be deleted as in step 42. If there is a difference of more than three days between the start of the flight in question and the date of the report, as shown in step 44, this may be indicative of the airline not routinely and completely downloading data from the CMC and therefore the data for this flight should be deleted as in step 46. The thresholds of twenty-five flights, fifty flights, and three days discussed above are illustrative of thresholds that may be used in one embodiment of the present invention. Other thresholds may be used as desired. While certain methods of identifying bad data are discussed above, these methods are illustrative and not intended to limit the scope of the present invention. Other methods of identifying bad data may be used as desired.

Figure 3:
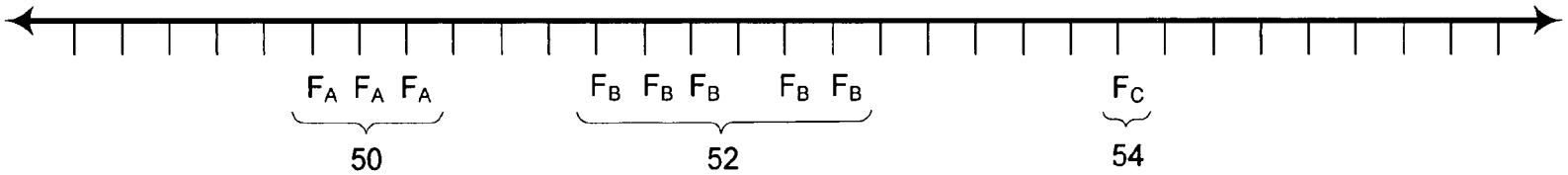
FIG. 3 is a timeline illustrating the identification of FDE strings.

After the bad data are removed, potentially significant pairs of MMSGs and failure messages, hereinafter discussed in terms of FDEs for purposes of example, may then be identified, as shown in step 48 of FIG. 2 and step 14 of FIG. 1. A potentially significant MMSG-FDE pair means that the specific MMSG may be predictive of the specific FDE. The first step in identifying potentially significant pairs is to identify FDE strings. An FDE string occurs when a specific FDE occurs in each of a series of one or more flights, uninterrupted by no more than one flight in which the specific FDE did not occur. FIG. 3 depicts a timeline illustrating the identification of FDE strings. In the timeline of FIG. 3, as well as the timelines of FIGS. 4, 5(*a*), 5(*b*), and 5(*c*), the timeline represents CMC data from one aircraft. Each time increment on the timelines represents one flight, each M symbol represents one MMSG recorded on that particular flight, and each F symbol represent one FDE recorded on that particular flight. As shown in FIG. 3, three FDE strings have been identified, 50, 52, and 54, for this aircraft. FDE string 50 is a string of three occurrences of a particular FDE designated as $F_A$. FDE string 54 is a string of one occurrence of a particular FDE designated as $F_C$. The specific FDE may occur during all flights in the series of flights for it to be considered one FDE string. Additionally, there may be one flight within the series of flights during which the FDE did not occur, and it may still be considered one FDE string. FDE string 52 is a string of five occurrences of a particular FDE designated as $F_B$, with the string interposed by one flight on which the FDE did not occur. If the series of flights is interposed by two or more consecutive flights during which the FDE did not occur, then more than one FDE string would be indicated. As discussed in detail below, a different method of identifying FDE strings may be used when calculating TTF.

Figure 4:
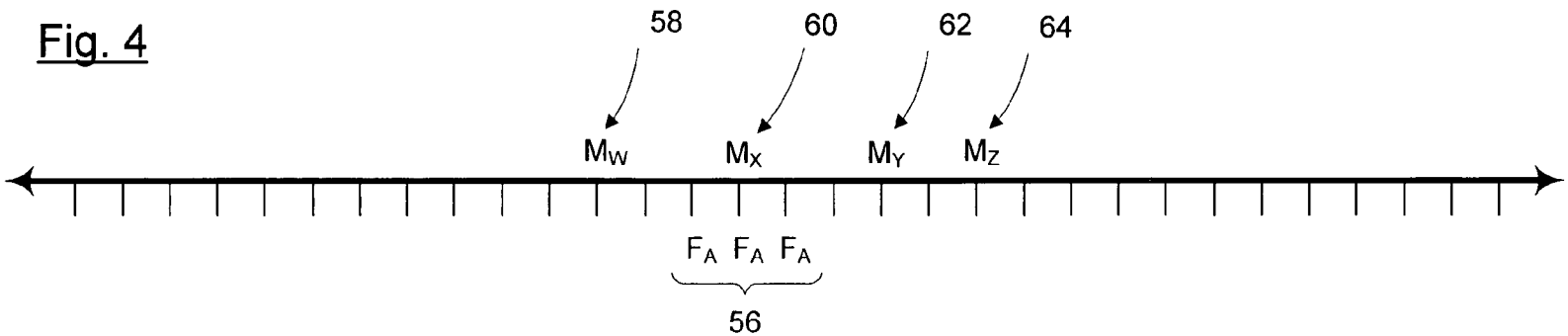
FIG. 4 is a timeline illustrating the identification of MMSGs that occur near an FDE string.

Once all FDE strings are identified, every MMSG that occurs near an FDE string is identified. FIG. 4 depicts a timeline illustrating the identification of MMSGs that occur near an FDE string. In this context, a MMSG occurs near an FDE string if it occurs during the same flights as the FDE string, or within a specified window of flights before or after the FDE string. In one embodiment of the present invention, the window of flights considered is three flights. Therefore, a specific MMSG is considered to be potentially significant if it occurs during the same flights as a specific FDE string, or if it occurs during the three flights preceding that FDE string or the three flights following that FDE string. As shown in FIG. 4, an FDE string 56 has been identified. MMSG 58 is deemed to occur near this FDE string because it occurs two flights before the FDE string. MMSG 60 is deemed to occur near this FDE string because it occurs during one of the flights on which the FDE string occurs. MMSG 62 is deemed to occur near this FDE string because it occurs two flights after the FDE string. However, MMSG 64 is not deemed to occur near this FDE string because it occurs four flights after the FDE string. It should be appreciated that the window of three flights is for illustrative purposes only. This window could be more or less than three flights, and the window of flights before the FDE string could be different than the window of flights after the FDE string. Therefore, in the example illustrated in FIG. 4 there are three potentially significant MMSG-FDE pairs: $M_W$-$F_A$, $M_X$-$F_A$, and $M_Y$-$F_A$. $M_Z$-$F_A$ is not a potentially significant MMSG-FDE pair based on the data in FIG. 4. However, it is possible that $M_Z$-$F_A$ could be determined to be potentially significant based on data from other aircraft of the same type (e.g., Boeing 777), or based on a different window of time on this same aircraft.

In one embodiment of the invention, additional methods of identifying potentially significant MMSG-FDE pairs may be used. An airplane CMC typically contains a fault propagation table, which is used by maintenance personnel to identify potential sources of faults. The fault propagation table relates all potential FDEs to one or more correlated MMSGs. The fault propagation table may be used to identify potentially significant MMSG-FDE pairs. Another method of identifying potentially significant MMSG-FDE pairs is to associate MMSGs to FDEs at the component level. Each MMSG is an indication of a failure that can be isolated to one or several components. By using a table listing the components associated with each MMSG, additional potentially significant MMSG-FDE pairs may be identified.

For every potentially significant MMSG-FDE pair that is identified, the frequency of occurrences of the MMSG before, after, and concurrently with the FDE is separately determined. This data are then analyzed, such as by means of ratios and ranking statistics, to determine which MMSG-FDE pair is significant, as shown in step 16 of FIG. 1.

Figures 5A, 5B, 5C:
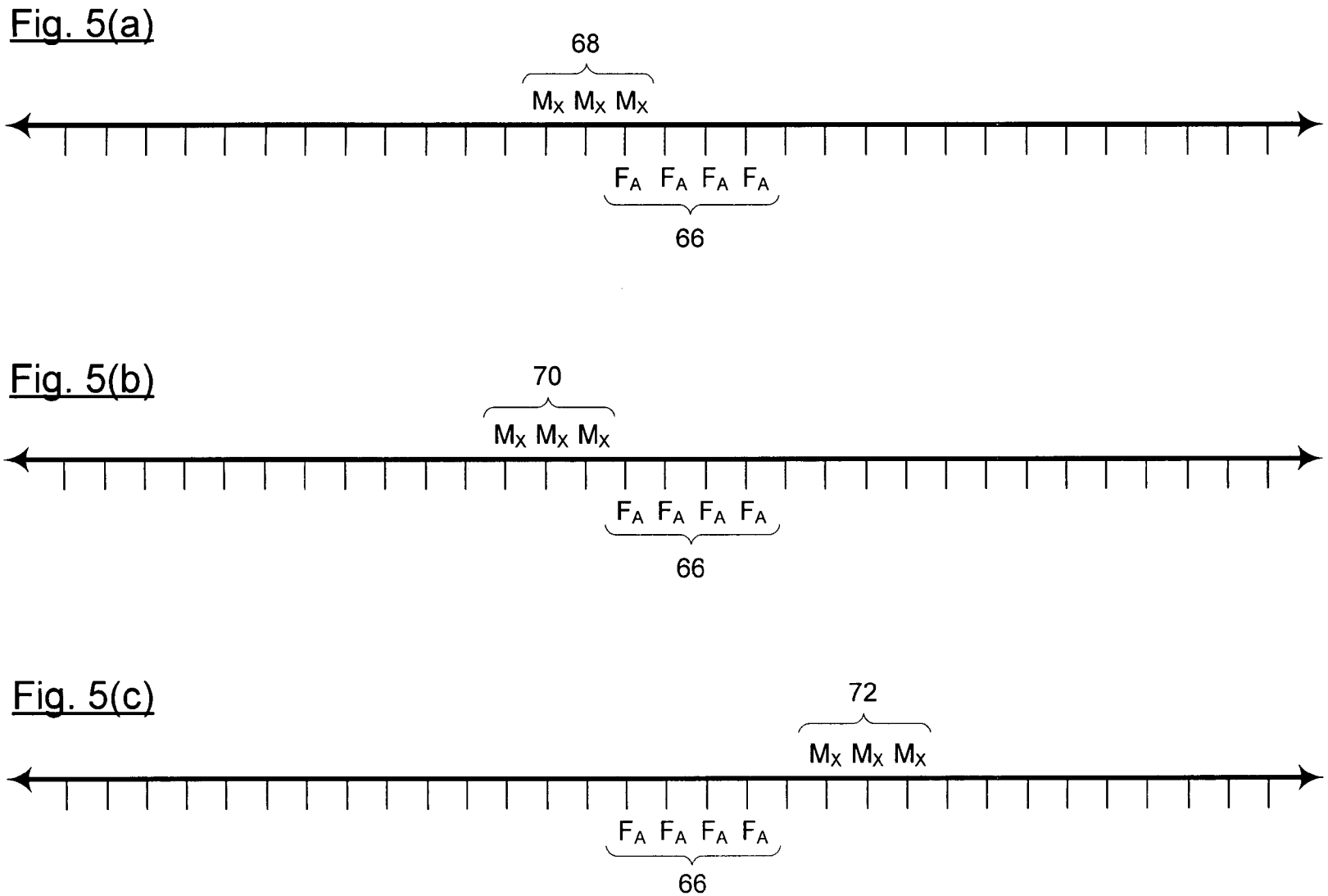
FIG. 5(*a*) is a timeline illustrating the identification of MMSGs that occur before and with an FDE string.

In this regard, for every potentially significant MMSG-FDE pair that is identified, a number of calculations are made to determine which MMSG-FDE pairs are truly significant and may include calculations to determine one or more of the following: (a) the number of times the specific MMSG occurs before and during the strings of that specific FDE (termed 'M(b/w)' for 'MMSG before and with'); (b) the number of times the specific MMSG occurs before but not during the strings of that specific FDE (termed 'M(b/wo)' for 'MMSG before and without'); and (c) the number of times the specific MMSG occurs after the strings of that specific FDE (termed 'M(a)' for 'MMSG after'). FIG. 5(*a*) depicts a timeline illustrating a MMSG 68 occurring before and during an FDE 66. As shown in FIG. 5(*a*), two instances of MMSG 68 occur before FDE 66 and one instance occurs during FDE 66. FIG. 5(*b*) depicts a timeline illustrating a MMSG 70 occurring before an FDE 66. As shown in FIG. 5(*b*), all three instances of MMSG 70 occur before FDE 66. FIG. 5(*c*) depicts a timeline illustrating a MMSG 72 occurring after an FDE 66. As shown in FIG. 5(*c*), all three instances of MMSG 72 occur after FDE 66. All of the MMSG-FDE data are reviewed and for every instance where this specific MMSG occurs near this specific FDE, M(b/w), M(b/wo), and M(a) are tabulated. Similarly, this is done for all potentially significant MMSG-FDE pairs.

Each of these three resulting numbers (M(b/w), M(b/wo), and M(a)) is divided by the total number of occurrences of the specific MMSG (termed M(t)), and each is separately divided by the total number of occurrences of the specific FDE (termed F(t)), giving six values for each potentially significant MMSG-FDE pair. The six values obtained for each potentially significant MMSG-FDE pair in this embodiment are: M(b/w)/M(t); M(b/wo)/M(t); M(a)/M(t); M(b/w)/F(t); M(b/wo)/F(t); and M(a)/F(t). In one embodiment of the invention, if any of these six values is greater than one, the datum is bad and should be deleted. In another embodiment, it may be determined that a value of less than, but nearly, one (e.g., 0.95) is indicative of bad data and should be deleted. Then the following four values may be calculated: M(b/w)/M(t) minus M(a)/M(t); M(b/wo)/M(t) minus M(a)/M(t); M(b/w)/F(t) minus M(a)/F(t); and M(b/wo)/F(t) minus M(a)/F(t). These four values for each potentially significant MMSG-FDE pair are illustrated in tabular form as shown in FIG. 6, where the four values are placed in columns A, B, C and D respectively. These four values for each potentially significant MMSG-FDE pair are then used to determine which MMSG-FDE pair is actually significant.

Figure 7:
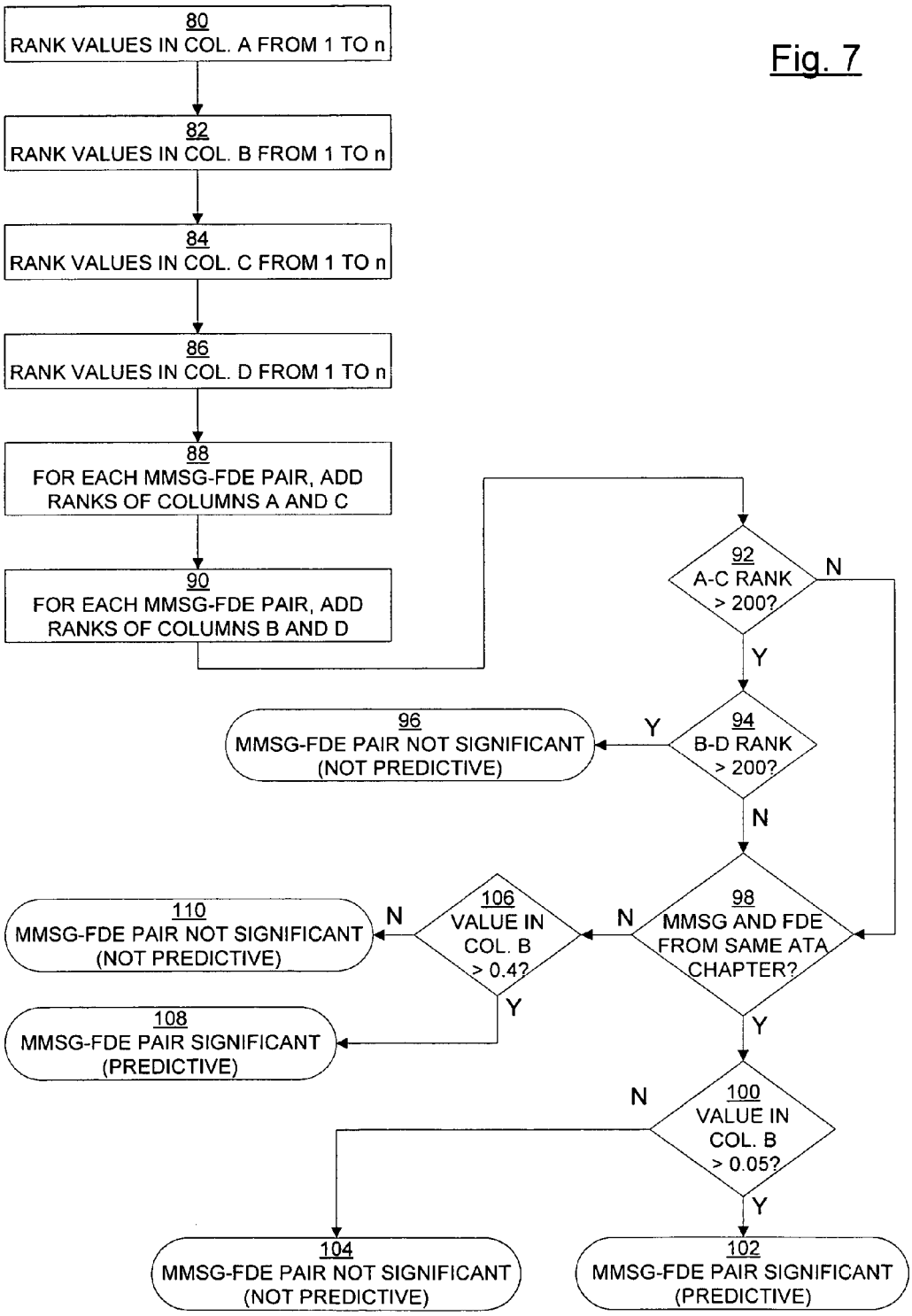
FIG. 7 is a flowchart illustrating the method of determining which potentially significant MMSG-FDE pairs are significant.

After the potentially significant MMSG-FDE pairs are identified, the next step is to determine which MMSG-FDE pair is actually significant, which, in this context, is defined to be an instance in which the MMSG of the pair is predictive of the FDE of the pair. FIG. 7 is a flowchart illustrating the method of determining which potentially significant MMSG-FDE pairs are significant. As shown in steps 80, 82, 84, and 86 of FIG. 7, each of the four values in columns A, B, C and D of FIG. 6 for each MMSG-FDE pair are ranked by value, with the highest value of each pair ranked as number one. For each MMSG-FDE pair, the rank of the value in column A is combined with the rank of the value in column C (termed 'A-C rank'), as shown in step 88, and the rank of the value in column B is combined with (e.g., added to) the rank of the value in column D (termed 'B-D rank'), as shown in step 90. For example, for a given MMSG-FDE pair, if the rank of the value in column A is 1 and the rank of the value in column C is 4 then the rank of A-C is 5.

A predefined cutoff is applied to the A-C rank and to the B-D rank. For each MMSG-FDE pair, if the A-C rank and the B-D rank are both lower (i.e. worse) than the cutoff value then that pair is not significant and is eliminated. This is illustrated in steps 92, 94, and 96. In one embodiment of the invention this cutoff value is 200. However, in other embodiments this cutoff value may be in the range of 50–350, or any appropriate value. A lower cutoff value, for examply fifty, may result in fewer unnecessary repairs but may also result in more unpredicted FDEs. A higher cutoff value, for example 350, may result in fewer unpredicted FDEs but may also result in more unnecessary repairs.

For the remaining MMSG-FDE pairs, that is, for the MMSG-FDE pairs having either the A-C rank or the B-D rank above the cutoff, one additional test is performed on the values in columns A and B to determine if the MMSG is predictive of the FDE. Each MMSG is determined to be a trigger, a precursor, both, or neither. A trigger is a MMSG that occurs predominantly at the same time as and not before the FDE, and therefore it is not predictive of the FDE. A precursor is a MMSG that occurs predominantly before the FDE, and therefore is predictive of the FDE. If the MMSG is both a trigger and a precursor then it is predictive of the specific FDE. If the MMSG is neither a trigger nor a precursor then it is not predictive.

If only the value in column A is high ('high' is defined below) for a particular MMSG-FDE pair, then that specific MMSG is a trigger for that specific FDE and is therefore not predictive. If the value in column B is high for a particular MMSG-FDE pair, then that specific MMSG is a precursor of that specific FDE and is therefore predictive. If both the value in column A and the value in column B are high, then the MMSG is both a trigger and a precursor, and therefore that specific MMSG is predictive of that specific FDE. If neither the value in column A nor the value in column B is high, then that specific MMSG is neither a trigger nor a precursor of that specific FDE and is therefore not predictive.

The definition of high in the above determination typically depends on whether the MMSG and the FDE in the specific MMSG-FDE pair are from the same aircraft system. Each aircraft system (e.g. autopilot, communications, navigation, etc.) is defined by one of approximately 50 chapters by the Air Transport Association, an airline industry group. In one embodiment of the present invention, if the MMSG and the FDE relate to the same system and therefore are from the same ATA chapter then high is defined as 0.05 to 0.10. If the MMSG and the FDE relate to different systems and therefore are from different ATA chapters, then high is defined as 0.40. These definitions of high may vary in other embodiments of the invention.

Steps 98 through 110 of FIG. 7 illustrate the final step, as discussed above, in determining whether a specific MMSG-FDE pair is significant. In step 98, it is determined whether the MMSG and the FDE relate to the same system, such as by being from the same ATA chapter. If the MMSG and the FDE relate to the same system and are from the same ATA chapter, then in step 100 it is determined if the value in column B is high by being greater than 0.05, in this exemplary embodiment. If it is greater, then the MMSG-FDE pair is significant (i.e. the MMSG is predictive of the FDE), as shown in step 102. If it is not greater than 0.05, then the MMSG-FDE pair is not significant (i.e. the MMSG is not predictive of the FDE), as shown in step 104. If the MMSG and the FDE do not relate to the same system as they are not from the same ATA chapter, then in step 106 it is determined if the value in column B is high by being greater than 0.40, in this exemplary embodiment. If it is greater, then the MMSG-FDE pair is significant (i.e. the MMSG is predictive of the FDE), as shown in step 108. If it is not greater than 0.4, then the MMSG-FDE pair is not significant (i.e. the MMSG is not predictive of the FDE), as shown in step 110.

The preceding steps comprise a method of determining which MMSGs are predictive of which FDEs. In one embodiment of the present invention, this predictive information is input to a vehicle monitoring and reporting system. The vehicle monitoring and reporting system may detect the existence of a predictive MMSG and may alert a user that the corresponding FDE is likely to occur in the future. In some embodiments of the invention, additional data may be combined with the predictive information to provide the user with additional information on which to base a maintenance decision. For example, the predictive information may be combined with data on how much time typically has elapsed between the occurrence of a certain MMSG and a corresponding FDE. Additionally, data on potential flight events, such as delays, cancellations, air turn-backs, and diversions that may occur given the occurrence of a certain FDE, along with the potential cost to the user of those events, may be included to assist the user with prioritizing maintenance requirements. Additionally, historical data on maintenance actions that may be taken in response to a certain FDE, such as the elapsed time of the maintenance, the labor hours involved, the delay involved, and the cost of the maintenance, may be included, as shown in step 22 of FIG. 1.

As mentioned above, the typical time that has elapsed between the occurrence of a certain MMSG and a corresponding FDE can be calculated. This is called the time-to-FDE (TTF). TTF can be calculated both as a number of flights and as a number of flight hours. The MMSG and FDE data collected in the prior steps contain numerous occurrences of MMSGs and related FDEs over numerous flights. To calculate TTF, MMSG strings and FDE strings must be identified for each significant MMSG-FDE pair. These strings are identified using a different method than the method used in the initial identification of FDE strings discussed above. To identify MMSG and FDE strings used in the calculation of TTF, a moving average is calculated. This moving average is called the intensity. For a specific MMSG occurring on a specific aircraft, the MMSG intensity is calculated for each flight. The MMSG intensity equals the number of times that specific MMSG occurred on that specific flight and on the preceding Y−1 flights, divided by Y. Y is called the MMSG intensity denominator or the window width, and the number of times the specific MMSG occurred on the Y flights in question is called the MMSG intensity numerator. The MMSG intensity is therefore a moving average of MMSG occurrences over a window of Y flights. In one embodiment, Y may be equal to 15 for a specific MMSG; however Y may vary for different MMSGs defined by different ATA chapters. For example, if the specific MMSG did not occur on the specific flight in question but occurred 3 times in the preceding 14 flights, then the MMSG intensity for that specific flight would be 0.2 (i.e. three divided by fifteen). As mentioned above, the MMSG intensity is calculated for every flight. The value of Y may be defined by engineering analysis. The lower the value of Y, the shorter the identified strings will be. Shorter strings result in lower TTF values, and are likely to result in a greater number of false alarms but a lower number of unscheduled interruptions. The higher the value of Y, the longer the identified strings will be. Longer strings result in higher TTF values, and are likely to result in a lower number of false alarms but a higher number of unscheduled interruptions.

After calculating the MMSG intensity for every flight, each flight is identified which has an MMSG intensity that exceeds a predefined threshold. This threshold is specified for every specific MMSG, and may vary based on engineering judgment of the importance of the MMSG. The lower the value of the predefined threshold, the shorter the identified strings will be. Shorter strings result in lower TTF values, and are likely to result in a greater number of false alarms but a lower number of unscheduled interruptions. The higher the value of the predefined threshold, the longer the identified strings will be. Longer strings result in higher TTF values, and are likely to result in a lower number of false alarms but a higher number of unscheduled interruptions. This threshold may be given as a ratio of MMSG intensity numerator to MMSG intensity denominator, or it may be given simply as the MMSG intensity numerator. For example, the threshold may be met for every flight where the MMSG intensity numerator is equal to or greater than 2. Each uninterrupted series of flights on which the MMSG intensity is greater than the threshold is considered an MMSG string.

In another embodiment of the invention, in addition to considering only the flights where the MMSG intensity exceeded the threshold to be part of the MMSG string, the string would also include any flights having that specific MMSG (these flights are called stragglers) and occurring within a predefined number of flights after the MMSG string (this number of flights is called the MMSG gap interval), as well as the flights between the MMSG string and the straggler.

In the same way that the MMSG strings are identified, the FDE strings may be identified. For each flight the FDE intensity is calculated, based on an FDE intensity denominator. Each flight is then identified which has an FDE intensity over a predefined threshold. This threshold is different than the MMSG threshold, and may vary according to the ATA chapter that defines the FDE. For example, for FDEs with no MEL dispatch relief, along with the corresponding MMSG, the FDE intensity denominator may be given a value of one. For FDEs with greater levels of MEL dispatch relief, a higher value for the FDE intensity denominator may be used. The lower the value of the predefined threshold, the shorter the identified strings will be. Shorter strings result in lower TTF values, and are likely to result in a greater number of false alarms but a lower number of unscheduled interruptions. The higher the value of the predefined threshold, the longer the identified strings will be. Longer strings result in higher TTF values, and are likely to result in a lower number of false alarms but a higher number of unscheduled interruptions. Each uninterrupted series of flights on which the FDE intensity is greater than the threshold is considered an FDE string, and the stragglers can be considered part of the string based on an FDE gap interval, if so desired.

Figure 8:
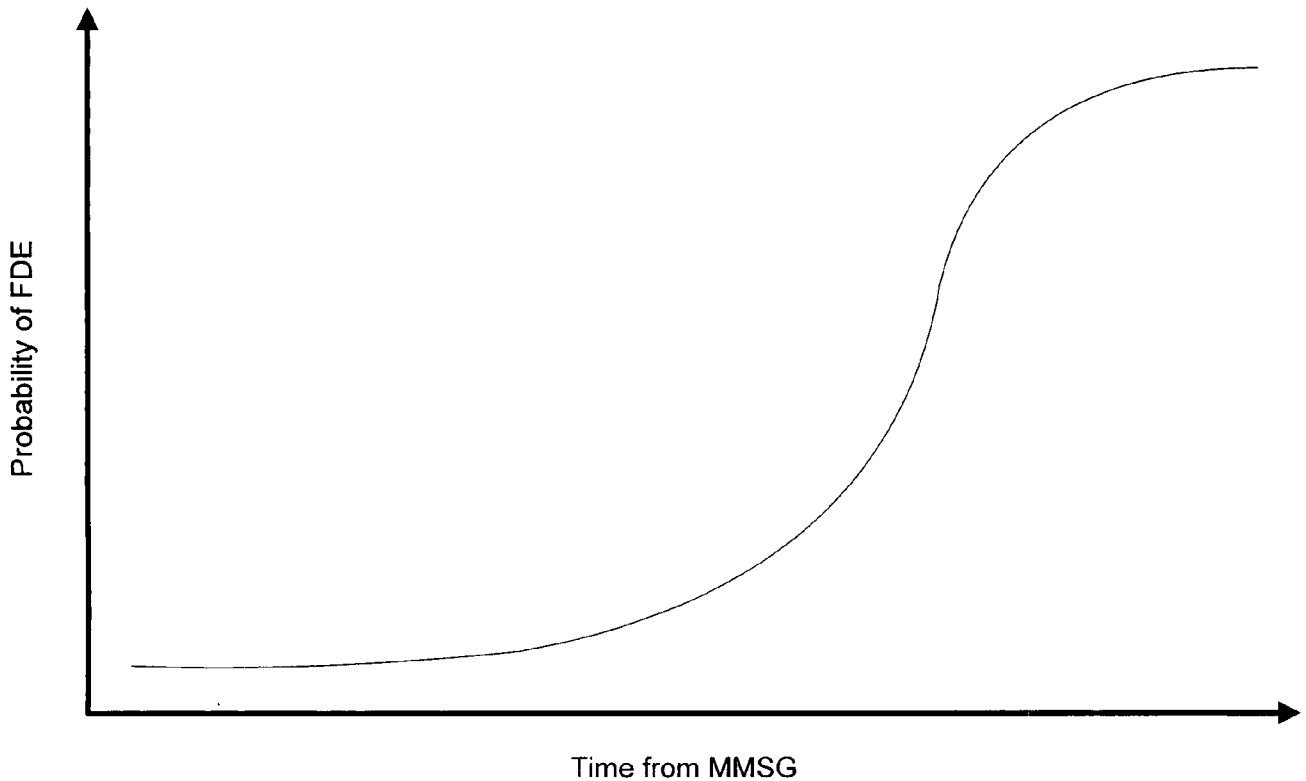
FIG. 8 illustrates the distribution of TTF data for a MMSG-FDE pair.

For each occurrence of an MMSG and a related FDE, the number of flights between the beginning of the MMSG string and the beginning the related FDE string (i.e., the TTF) can be determined. This provides a distribution of TTF data such that the TTF can be expressed as a percentile. For example, for a given MMSG-FDE pair, 25% of the FDEs occur within a calculated number of flights of the flight on which the corresponding MMSG occurred. In one embodiment of the invention, this data are calculated for the 25th percentile, the 50th percentile, the 75th percentile, and the 90th percentile. Additionally, the minimum TTF (i.e., the shortest number of flights between an occurrence of the MMSG and an occurrence of the FDE) and the maximum TTF (i.e., the longest number of flights between an occurrence of the MMSG and an occurrence of the FDE) can be calculated. The TTF can be calculated for all MMSG-FDE pairs, which provides the TTF for a specific MMSG and a specific FDE. Additionally, the TTF can be calculated for a certain MMSG to the occurrence of any related FDE. The TTF may be calculated in number of flight hours by determining the origin and destination airports for each flight and applying an industry average flight time for the given origin-destination. FIG. 8 illustrates another method of displaying the TTF data for a given MMSG-FDE pair. FIG. 8 shows a distribution of TTF data, where the X-axis is the time (either in flights or flight hours) from the occurrence of the MMSG, and the Y-axis is the probability of the FDE occurring.

In one embodiment of the invention, the TTF data may be expressed as a probability model. This may be accomplished by using, for example, exponential modeling to fit a smooth curve to the TTF data. The exponential models may then be used to calculate the probability that an FDE will occur within a particular number of flights or flight hours. Additionally, the models may calculate the number of flights or flight hours whose probability is less than a particular percentage.

As mentioned above, data on potential flight events, such as delays, cancellations, air turn-backs, and diversions, that may occur given the occurrence of a certain FDE, along with the potential cost to the user of those events, may be included to assist the user with prioritizing maintenance requirements. Additionally, data on maintenance actions that may be taken in response to a certain FDE, such as the elapsed time of the maintenance, the labor hours involved, the delay involved, and the cost of the maintenance, may be included.

The FDE occurrence data are extracted from the CMC. The flight event and maintenance data are extracted from a ground-based maintenance database, such as an Airplane Reliability and Maintainability System (ARMS). The FDE data and the flight event and maintenance data must be matched and combined to provide information to the user regarding the flight event and maintenance time and costs. To match a specific FDE to a specific flight event, each must have the same airplane serial number, each must involve a system defined by the same ATA chapter, the FDE must not occur after the flight event, and the FDE must occur on the same day as or one day before the flight event. Although the FDE and the flight event must be defined by the same ATA chapter to be matched, the ATA chapter data are not always entered accurately in the ARMS. Therefore, the ATA chapter may be matched using key words rather than necessarily by chapter number. The FDE may occur on the day prior to the flight event because the flight may have originated on one day and terminated on the following day.

When all the FDEs have been matched to corresponding flight events, the likelihood of a specific event occurring in response to a specific FDE can be calculated. In addition, when the event is a delay, the mean and standard deviation of delay time can be calculated for each FDE. Once the mean delay time is calculated, the delay cost for a specific FDE can be calculated based on industry average costs per increment of delay time.

As discussed above, the FDE occurrence data are extracted from the CMC, the flight maintenance data are extracted from the ARMS, and the FDE data and the flight maintenance data may be matched and combined. To match a specific FDE to a specific maintenance event, each must have the same airplane serial number, each must be defined by the same ATA chapter, the maintenance location must be the same as the flight destination, the FDE must occur on the same day as or one day before the maintenance event, and the flight departure must be on the same day or one day before the FDE. When all the FDEs have been matched to corresponding maintenance events, the average elapsed maintenance time, the average labor hours, and the average delay due to maintenance can all be calculated for each specific FDE.

With significant MMSGs identified along with their corresponding FDEs, the TTF quantified, and the likelihood and associated costs of flight events determined, this data can be summarized and output to the vehicle monitoring and reporting system, as shown in step 24 of FIG. 1. Alternatively, this system, method, and computer program product may be integrated within a vehicle monitoring and reporting system, if so desired.

In one embodiment of the present invention, three files are output to the vehicle monitoring and reporting system: MMSG-FDE risk and TTF; MMSG risk and TTF; and FDE risk and cost.

In the first output file, data are given regarding a specific MMSG-FDE pair. The data are typically presented in tabular form, with each row containing the data for one specific MMSG-FDE pair. The columns of data for each specific MMSG-FDE pair may include the risk of a specific FDE given a specific MMSG, the TTF to that specific FDE, and how strong the prediction is of that specific FDE. Specifically, the columns of data may be as follows:

Numfdes=the number of times the specific FDE appeared.

Mincyc=in all available data history, the minimum number of cycles observed between an occurrence of the specific MMSG and an occurrence of the specific FDE.

Minhrs=in all available data history, the minimum number of hours observed between an occurrence of the specific MMSG and an occurrence of the specific FDE.

P25_cyc=25% of all observed occurrences of the specific MMSG to the specific FDE occurred within this number of cycles.

P25_hrs=25% of all observed occurrences of the specific MMSG to the specific FDE occurred within this number of hours.

P50_cyc=50% of all observed occurrences of the specific MMSG to the specific FDE occurred within this number of cycles; also known as the median TTF in cycles.

P50_hrs=50% of all observed occurrences of the specific MMSG to the specific FDE occurred within this number of hours; also known as the median TTF in hours.

P75_cyc=75% of all observed occurrences of the specific MMSG to the specific FDE occurred within this number of cycles.

P75_hrs=75% of all observed occurrences of the specific MMSG to the specific FDE occurred within this number of hours.

P90_cyc=90% of all observed occurrences of the specific MMSG to the specific FDE occurred within this number of cycles.

P90_hrs=90% of all observed occurrences of the specific MMSG to the specific FDE occurred within this number of hours.

Max_cyc=in all available data history, this was the maximum number of cycles observed between an occurrence of the specific MMSG and an occurrence of the specific FDE.

Max_hrs=in all available data history, what was the maximum number of hours observed between an occurrence of the specific MMSG and an occurrence of the specific FDE.

Numprec=the number of the MMSG instance that resulted in an FDE being predicted in more than 2 flights (i.e. the maintenance message occurrence acted as a precursor to the related FDE).

Numtrig=the number of the MMSG instances that resulted in an FDE being predicted in fewer than 3 (i.e. 0, 1 or 2) flights. In these cases, the MMSG acts as a trigger to an FDE and does not give airlines enough time to make corrective maintenance action.

NumFA=the number of MMSG instances that terminated before an FDE occurred (i.e. this measures the number of false alarms, where a message is deemed to be related to an FDE and it was not seen in the data).

Num_m_strings=the number of times the MMSG appeared in the historic data.

Percprec=numprec/num_m_strings=a measure of the precursor predictive power of a maintenance message, given a related FDE. The higher this value, the more predictive a maintenance message.

Perctrig=numtrig/num_m_strings=a measure of the short term predictive power of a MMSG, given a related FDE. A high perctrig value implies that the MMSG is only able to predict the FDE with a very short lead time and may be of little use to airlines in adjusting their maintenance schedule to preempt the FDE.

percFA=numFA/num_m_strings=a measure of the false alarm rate of a MMSG. This is important as decisions on high cost intervention maintenance actions may be taken in light of the false alarm rate.

M(b/w)=the number of times the specific MMSG occurs before and during the strings of that specific FDE.

M(b/wo)=the number of times the specific MMSG occurs before but not during the strings of that specific FDE.

M(a)=the number of times the specific MMSG occurs after the strings of that specific FDE.

In the second output file, data are given regarding a specific MMSG and the risk of any FDE associated with that MMSG. The data are typically presented in tabular form, with each row containing the data for one specific MMSG. The columns of data for each specific MMSG may include the risk of any FDE given a specific MMSG, the TTF to any FDE, and how strong the prediction is of any FDE occurring. Specifically, the columns of data may be as follows:

Mincyc=in all available data history, the minimum number of cycles observed between an occurrence of the specific MMSG and an occurrence of any FDE.

Minhrs=in all available data history, the minimum number of hours observed between an occurrence of the specific MMSG and an occurrence of any FDE.

P25_cyc=25% of all observed occurrences of the specific MMSG to any FDE occurred within this number of cycles.

P25_hrs=25% of all observed occurrences of the specific MMSG to any FDE occurred within this number of hours.

P50_cyc=50% of all observed occurrences of the specific MMSG to any FDE occurred within this number of cycles; also known as the median TTF in cycles.

P50_hrs=50% of all observed occurrences of the specific MMSG to any FDE occurred within this number of hours; also known as the median TTF in hours.

P75_cyc=75% of all observed occurrences of the specific MMSG to any FDE occurred within this number of cycles.

P75_hrs=75% of all observed occurrences of the specific MMSG to any FDE occurred within this number of hours.

P90_cyc=90% of all observed occurrences of the specific MMSG to any FDE occurred within this number of cycles.

P90_hrs=90% of all observed occurrences of the specific MMSG to any FDE occurred within this number of hours.

Max_cyc=in all available data history, this was the maximum number of cycles observed between an occurrence of the specific MMSG and an occurrence of any FDE.

Max_hrs=in all available data history, what was the maximum number of hours observed between an occurrence of the specific MMSG and an occurrence of any FDE.

Totstrings=the number of times the MMSG appeared in the historic data.

Numtrig=the number of the MMSG instances that resulted in an FDE being predicted in fewer than 3 (i.e. 0, 1 or 2) flights. In these cases, the MMSG acts as a trigger to an FDE and does not give airlines enough time to make corrective maintenance action.

Perctrigger=numtrig/totstrings=a measure of the short term predictive power of a MMSG, given any related FDE. A high perctrigger value implies that the MMSG is only able to predict the FDE with a very short lead time and may be of little use to airlines in adjusting their maintenance schedule to preempt the FDE.

Totprec=the number of the MMSG instance that resulted in an FDE being predicted in more than 2 flights (i.e. the maintenance message occurrence acted as a precursor to any related FDE).

Percprec=totprec/totstrings=a measure of the precursor predictive power of a maintenance message, given any related FDE. The higher this value, the more predictive a maintenance message.

Percmax=the largest length for which the message was a precursor.

Risknorm=normalized risk=100*risk/max(risk), where max(risk) is the maximum risk across all maintenance messages.

In the third output file, data are given regarding a specific FDE and the risk of a flight event associated with that FDE. The data are typically presented in tabular form, with each row containing the data for one specific FDE. The columns of data for each specific MMSG may include the number of flight events, and, where the flight event is a delay, the length of the delay. Specifically, the columns of data may be as follows:

Total_Strings=number of total FDE strings in the MMMS database.

Matched_Strings=number of FDE strings that are matched to the ARMS data that contain cancellation, diversion, air turn-back and delay information.

Cancel_Number=number of cancellation instances that are caused by the specific FDE.

Diversion_Number=number of diversion instances that are caused by the specific FDE.

Turn-back_Number=number of turn-back instances that are caused by the specific FDE.

Delay_Number=number of delay instances that are caused by the specific FDE.

Delay_Time (mean)=average of the delay time in hours caused by the specific FDE.

Delay_Time (s.d.)=sample standard deviation of delay time in hours caused by the specific FDE.

Probability_of delay=delay_number/total_strings.

Probability_of_cancellation=cancel_number/total_strings.

Probability_of_turn-back=turn-back_number/total_strings.

Probability_of_diversion=diversion_number/total_strings.

It should be appreciated that the probability calculations included in the third output file (probability of delay, probability of cancellation, probability of turn-back, and probability of diversion) may be calculated using variations of these ratios. For example, it may be desirable to add 0.5 or 1.0 to the numerators of these ratios, which is a commonly known technique in statistical analysis.

From the output discussed above, the vehicle monitoring and reporting system can determine the priority of each MMSG, typically based on one or more of the frequency of occurrences of related FDEs, the strength of the failure prediction, the TTF, the cost of maintenance, the likelihood of flight delays and other similar events, the cost of flight delays and other similar events, and the user's minimum equipment list (which specifies how long a user can wait to repair a specific component, based in part on the redundancy of that component). The user can customize the vehicle monitoring and reporting system by differently weighting each of these factors as desired to meet the maintenance requirements of the particular user.

Additionally, an expected risk value may be calculated and utilized in maintenance decision. Expected risk equals ((probability_of_delay * cost of delay)+(probability_of_cancellation * cost of cancellation)+(probability_of_turn-back*cost of turn-back)+(probability_of_diversion * cost of diversion)). To calculate this value, the cost of delay, cost of cancellation, cost of turn-back, and cost of diversion are all obtained from industry average data.

Figure 9:
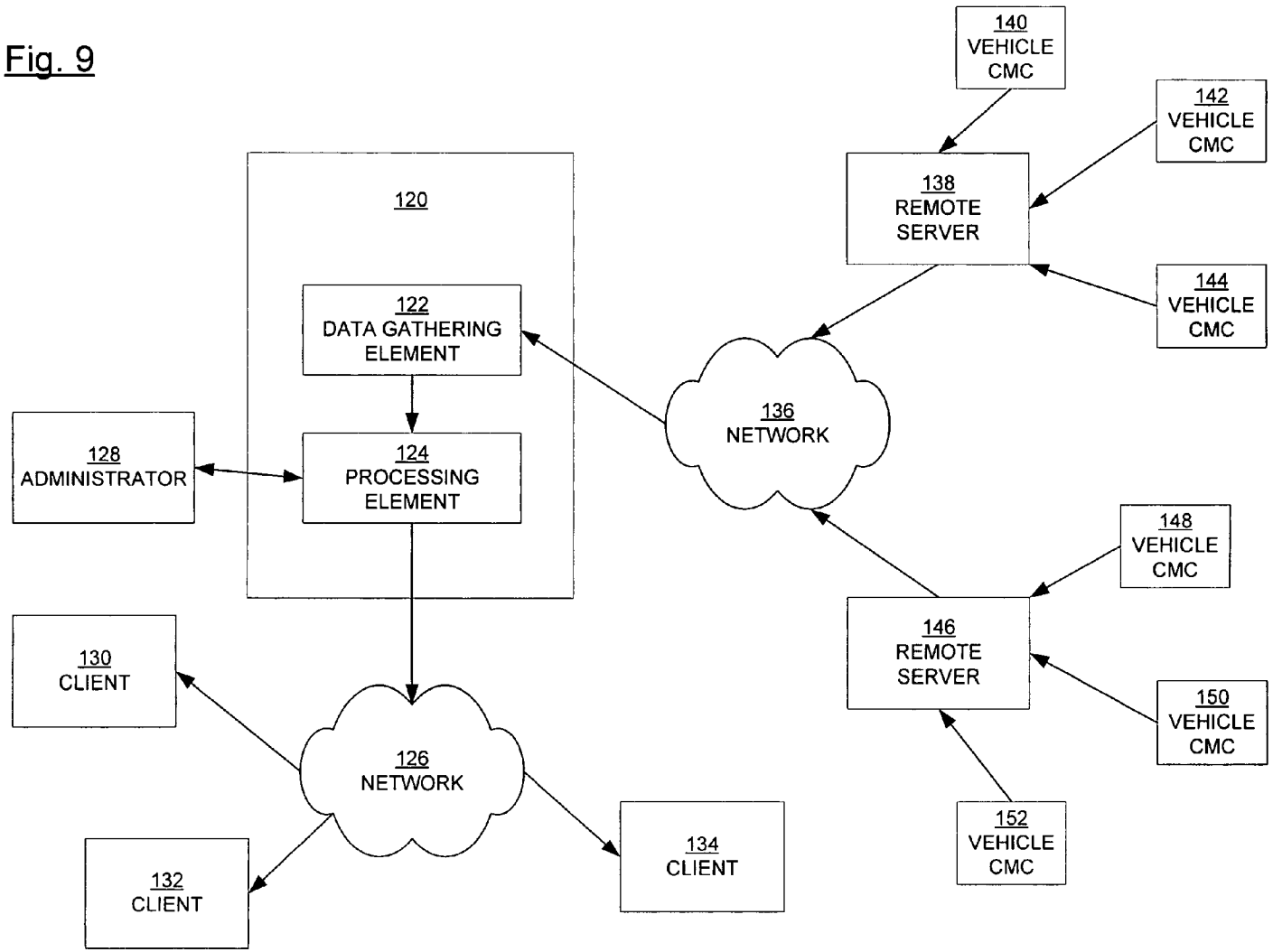
FIG. 9 illustrates a schematic block diagram of system for predicting faults in a vehicle monitoring and reporting system, according to one embodiment of the present invention

FIG. 9 is a schematic block diagram of a system for predicting fault in a vehicle monitoring and reporting system, according to one embodiment of the present invention. FIG. 9 illustrates a system using a client/server configuration. In the exemplary system of FIG. 9, maintenance message data and fault data are consolidated and reported in a vehicle central maintenance computer, such as an airplane CMC discussed in detail above. Typically, many vehicles in a commercial fleet of vehicles will have a CMC, and the data from the CMCs of each vehicle are routinely and automatically downloaded to a remote server. For example, in an aircraft monitoring and reporting system, each airplane in an airline's fleet typically has a CMC. Each airline will typically have one or more remote servers, such that the data from each airplane CMC may be downloaded to the remote servers. The remote servers may be located at each major airport so that the data from the CMC can be downloaded when an airplane is at such an airport. Alternatively, the remote servers may be located at the airline's hub airports, or at the airline's maintenance hubs. Another alternative configuration may be for the remote servers to be operated by a third party separate from the airlines, in which configuration the remote servers would likely be located at a facility operated by the third party. As illustrated in FIG. 9, a number of different vehicles, shown as 140, 142, and 144, may download their data to remote server 138 at one location. These actions may be repeated by different vehicles, shown as 148, 150, and 152, downloading their data to remote server 146 at a different location. FIG. 9 illustrates six vehicles downloading data to two different remote servers at two different locations. It should be appreciated, however, that in a large vehicle monitoring and reporting system, such as for an airline, the number of vehicles and remote servers may be significantly greater.

Remote servers 138 and 146 are connected via a network 136 to a central server 120. Network 136 may be any type of network, such as the Internet or a proprietary network. Central server 120 receives the maintenance message and fault data from the remote servers via a data gathering element 122. The data are then sent to a processing element 124 where the data are analyzed to determine which MMSG-FDE pairs are significant, where time-to-FDE is calculated, and where the data are formatted for output. An administrator 128 interfaces with the central server 120. The administrator may, for example, define the thresholds discussed in detail above, such as the thresholds for eliminating bad data or the window of flights used to determine which MMSGs occur near which FDEs.

In one embodiment of the system of the present invention, the significant MMSG-FDE pairs and the TTF data are output to various clients, for example vehicle fleet operators, to use in the operators' own vehicle monitoring and reporting system. These various clients are illustrated in FIG. 9 as 130, 132, and 134. The central server 120 sends this data to the various clients via a network 126, which may be the Internet or a proprietary network.

While FIG. 9 illustrates a system of the present invention using a client/server configuration, it should be appreciated that the client/server configuration is shown for example purposes only and that the system of the present invention could utilize configurations other than client/server. It should also be appreciated that the overall system architecture shown in FIG. 9 is for example purposes only, and not intended to limit the scope of the present invention. The system of the present invention could be implemented using a number of different system configurations.

The method of fault prediction in a vehicle monitoring and reporting system may be embodied by a computer program product. The computer program product includes a computer-readable storage medium, such as the non-volatile storage medium, and computer-readable program code portions, such as a series of computer instructions, embodied in the computer-readable storage medium. Typically, the computer program is stored by a memory device and executed by an associated processing unit, such as the flight control computer or the like.

In this regard, FIGS. 1, 2, and 7 are block diagrams and flowcharts of methods and program products according to the invention. It will be understood that each block or step of the block diagram and flowchart, and combinations of blocks in the block diagram and flowchart, can be implemented by computer program instructions. These computer program instructions may be loaded onto a computer or other programmable apparatus to produce a machine, such that the instructions which execute on the computer or other programmable apparatus create means for implementing the functions specified in the block diagram or flowchart block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the block diagram or flowchart block(s) or step(s). The computer program instructions may also be loaded onto a computer or other programmable apparatus to cause a series of operational steps to be performed on the computer or other programmable apparatus to produce a computer implemented process such that the instructions which execute on the computer or other programmable apparatus provide steps for implementing the functions specified in the block diagram or flowchart block(s) or step(s).

Accordingly, blocks or steps of the block diagram or flowchart support combinations of means for performing the specified functions, combinations of steps for performing the specified functions and program instruction means for performing the specified functions. It will also be understood that each block or step of the block diagram or flowchart, and combinations of blocks or steps in the block diagram or flowchart, can be implemented by special purpose hardware-based computer systems which perform the specified functions or steps, or combinations of special purpose hardware and computer instructions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of predicting when to perform maintenance affecting operation of a vehicle, wherein the method comprises:

receiving maintenance message data and fault message data associated with operation of the vehicle, wherein the maintenance message data comprise a plurality of maintenance messages and the fault message data comprise a plurality of fault messages;

determining a predictive relationship between the maintenance message data and the fault message data such that the occurrence of at least one of the plurality of maintenance messages indicates a corresponding one of the plurality of fault messages will occur in the future; and performing maintenance on the vehicle upon the occurrence of one of the plurality of maintenance messages to prevent the occurrence of the corresponding one of the plurality of fault messages.

2. A method for predicting faults affecting operation of a vehicle, wherein the method comprises:

receiving maintenance message data and fault message data associated with operation of the vehicle, wherein the maintenance message data comprise a plurality of maintenance messages and the fault message data comprise a plurality of fault messages;

determining which types of the plurality of maintenance messages occur within a predefined number of vehicle operations from a respective one of the plurality of fault messages;

counting occurrences of at least one type of maintenance message occurring within the predefined number of vehicle operations from the respective fault message;

counting total occurrences of the at least one type of maintenance message; and determining if the at least one type of maintenance message is predictive of the respective fault message based on the count of the occurrences of the at least one type of maintenance message occurring within the predefined number of vehicle operations from the respective fault message and based on the count of the total occurrences of the at least one type of maintenance message.

3. The method of claim 2, wherein determining if the at least one type of maintenance message is predictive of the respective fault message comprises:

calculating a first ratio of the occurrences of the at least one type of maintenance message occurring within the predefined number of vehicle operations from the respective fault message to the total occurrences of the at least one type of maintenance message; and eliminating any types of maintenance messages with the first ratio being less than a first cutoff threshold.

4. The method of claim 2 further comprising:

counting total occurrences of the respective fault message; and determining if the at least one type of maintenance message is predictive of the respective fault message based on the count of the occurrences of the at least one type of maintenance message occurring within the predefined number of vehicle operations from the respective fault message and based on the count of the total occurrences of the respective fault message.

5. The method of claim 4, wherein determining if the at least one type of maintenance message is predictive of the respective fault message comprises:

calculating a second ratio of the occurrences of the at least one type of maintenance message occurring within the predefined number of vehicle operations from the respective fault message to the total occurrences of the respective fault message; and eliminating any types of maintenance messages with the second ratio being less than a second cutoff threshold.

6. The method of claim 3 further comprising ranking the first ratio and eliminating any types of maintenance messages with the ranking of the first ratio being lower than a third cutoff threshold.

7. The method of claim 5 further comprising ranking the second ratio and eliminating any types of maintenance messages with the ranking of the second ratio being lower than a fourth cutoff threshold.

8. The method of claim 2 further comprising eliminating maintenance message data and fault message data associated with testing of the vehicle.

9. The method of claim 2 wherein the vehicle is an aircraft.

10. The method of claim 2 further comprising counting vehicle operations between the occurrence of each maintenance message and the occurrence of the respective fault message.

11. The method of claim 10 further comprising determining origins and destinations for the vehicle operations, and determining a duration of each vehicle operation using industry average durations.

12. The method of claim 2 wherein the vehicle comprises a plurality of systems and wherein each of the plurality of maintenance messages is related to one of the plurality of vehicle systems and each of the plurality of fault messages is related to one of the plurality of vehicle systems.

13. The method of claim 12 further comprising:

receiving vehicle event data related to the operation of the vehicle wherein the vehicle event data comprise a plurality of vehicle events and wherein each of the plurality of vehicle events is related to one of the plurality of vehicle systems;

determining which of the plurality of vehicle events occurred on the same vehicle as the one of the plurality of fault messages, occurred on the same day as the one of the plurality of fault messages, and are related to the same vehicle system as the one of the plurality of fault messages.

14. The method of claim 13 wherein the plurality of vehicle events comprises delay events, cancellation events, turn-back events, and diversion events.

15. A system for predicting faults affecting operation of a vehicle comprising:

a processing element comprising:

a data gathering element for receiving maintenance message data and fault message data associated with operation of the vehicle, wherein the maintenance message data comprise a plurality of maintenance messages and the fault message data comprise a plurality of fault messages;

a first determination element for determining which types of the plurality of maintenance messages occur within a predefined number of vehicle operations from a respective one of the plurality of fault messages;

a counting element for counting occurrences of at least one type of maintenance message occurring within the predefined number of vehicle operations from the respective fault message, and for counting total occurrences of the at least one type of maintenance message; and a second determination element for determining if the at least one type of maintenance message is predictive of the respective fault message based on the count of the occurrences of the at least one type of maintenance message occurring within the predefined number of vehicle operations from the respective fault message and based on the count of the total occurrences of the at least one type of maintenance message.

16. The system of claim 15, wherein determining if the at least one type of maintenance message is predictive of the respective fault message comprises:

calculating a first ratio of the occurrences of the at least one type of maintenance message occurring within the predefined number of vehicle operations from the respective fault message to the total occurrences of the at least one type of maintenance message; and eliminating any types of maintenance messages with the first ratio being less than a first cutoff threshold.

17. The system of claim 15:

wherein the counting element counts total occurrences of the respective fault message; and wherein the second determination element determines if the at least one type of maintenance message is predictive of the respective fault message based on the count of the occurrences of the at least one type of maintenance message occurring within the predefined number of vehicle operations from the respective fault message and based on the count of the total occurrences of the respective fault message.

18. The system of claim 17, wherein determining if the at least one type of maintenance message is predictive of the respective fault message comprises:

calculating a second ratio of the occurrences of the at least one type of maintenance message occurring within the predefined number of vehicle operations from the respective fault message to the total occurrences of the respective fault message; and eliminating any types of maintenance messages with the second ratio being less than a second cutoff threshold.

19. The system of claim 16 wherein the second determination element determines a ranking of the first ratio and eliminates any types of maintenance messages with the ranking of the first ratio being lower than a third cutoff threshold.

20. The system of claim 18 wherein the second determination element determines a ranking of the second ratio and eliminates any types of maintenance messages with the ranking of the second ratio being lower than a fourth cutoff threshold.

21. The system of claim 15 further comprising a discrimination element for eliminating maintenance message data and fault message data associated with testing of the vehicle.

22. The system of claim 15 wherein the vehicle is an aircraft.

23. The system of claim 15 where the counting element counts vehicle operations between the occurrence of each maintenance message and the occurrence of the respective fault message.

24. The system of claim 23 further comprising a third determination element for determining origins and destinations for the vehicle operations, and for determining a duration of each vehicle operation using industry average durations.

25. The system of claim 15 wherein the vehicle comprises a plurality of systems and wherein each of the plurality of maintenance messages is related to one of the plurality of vehicle systems and each of the plurality of fault messages is related to one of the plurality of vehicle systems.

26. The system of claim 25 further comprising:

a second data gathering element for receiving vehicle event data related to the operation of the vehicle wherein the vehicle event data comprise a plurality of vehicle events and wherein each of the plurality of vehicle events is related to one of the plurality of vehicle systems;

a fourth determination element for determining which of the plurality of vehicle events occurred on the same vehicle as the one of the plurality of fault messages, occurred on the same day as the one of the plurality of fault messages, and are related to the same vehicle system as the one of the plurality of fault messages.

27. The system of claim 26 wherein the plurality of vehicle events comprises delay events, cancellation events, turn-back events, and diversion events.

28. A computer program product for predicting faults affecting operation of a vehicle, the computer program product comprising at least one computer-readable storage medium having computer-readable program code portions stored therein, the computer-readable program code portions comprising:

a first executable portion for receiving maintenance message data and fault message data associated with operation of the vehicle, wherein the maintenance message data comprise a plurality of maintenance messages and the fault message data comprise a plurality of fault messages;

a second executable portion for determining which types of the plurality of maintenance messages occur within a predefined number of vehicle operations from a respective one of the plurality of fault messages;

a third executable portion for counting occurrences of at least one type of maintenance message occurring within the predefined number of vehicle operations from the respective fault message;

a fourth executable portion for counting total occurrences of the at least one type of maintenance message; and a fifth executable portion for determining if the at least one type of maintenance message is predictive of the respective fault message based on the count of the occurrences of the at least one type of maintenance message occurring within the predefined number of vehicle operations from the respective fault message and based on the count of the total occurrences of the at least one type of maintenance message.

29. The computer program product of claim 28, wherein determining if the at least one type of maintenance message is predictive of the respective fault message comprises:

calculating a first ratio of the occurrences of the at least one type of maintenance message occurring within the predefined number of vehicle operations from the respective fault message to the total occurrences of the at least one type of maintenance message; and eliminating any types of maintenance messages with the first ratio being less than a first cutoff threshold.

30. The computer program product of claim 28 further comprising:

a sixth executable portion for counting total occurrences of the respective fault message; and a seventh executable portion for determining if the at least one type of maintenance message is predictive of the respective fault message based on the count of the occurrences of the at least one type of maintenance message occurring within the predefined number of vehicle operations from the respective fault message and based on the count of the total occurrences of the respective fault message.

31. The computer program product of claim 30, wherein determining if the at least one type of maintenance message is predictive of the respective fault message comprises:

calculating a second ratio of the occurrences of the at least one type of maintenance message occurring within the predefined number of vehicle operations from the respective fault message to the total occurrences of the respective fault message; and eliminating any types of maintenance messages with the second ratio being less than a second cutoff threshold.

32. The computer program product of claim 29 further comprising:

an sixth executable portion for ranking the first ratio and eliminating any types of maintenance messages with the ranking of the first ratio being lower than a third cutoff threshold.

33. The computer program product of claim 31 further comprising:

a eighth executable portion for ranking the second ratio and eliminating any types of maintenance messages with the ranking of the second ratio being lower than a fourth cutoff threshold.

34. The computer program product of claim 28 further comprising:

a sixth executable portion for eliminating maintenance message data and fault message data associated with testing of the vehicle.

35. The computer program product of claim 28 wherein the vehicle is an aircraft.

36. The computer program product of claim 28 further comprising:

an sixth executable portion for counting vehicle operations between the occurrence of each maintenance message and the occurrence of the respective fault message.

37. The computer program product of claim 36 further comprising:

a seventh executable portion for determining origins and destinations for the vehicle operations, and determining a duration of each vehicle operation using industry average durations.

38. The computer program product of claim 28 wherein the vehicle comprises a plurality of systems and wherein each of the plurality of maintenance messages is related to one of the plurality of vehicle systems and each of the plurality of fault messages is related to one of the plurality of vehicle systems.

39. The computer program product of claim 38 further comprising:

a sixth executable portion for receiving vehicle event data related to the operation of the vehicle wherein the vehicle event data comprise a plurality of vehicle events and wherein each of the plurality of vehicle events is related to one of the plurality of vehicle systems;

a seventh executable portion for determining which of the plurality of vehicle events occurred on the same vehicle as the one of the plurality of fault messages, occurred on the same day as the one of the plurality of fault messages, and are related to the same vehicle system as the one of the plurality of fault messages.

40. The computer program product of claim 39 wherein the plurality of vehicle events comprises delay events, cancellation events, turn-back events, and diversion events.

41. A method for predicting faults affecting operation of a vehicle, wherein the method comprises:

receiving maintenance message data and fault message data associated with operation of the vehicle, wherein the maintenance message data comprise a plurality of maintenance messages and the fault message data comprise a plurality of fault messages;

determining any temporal relationship between each type of maintenance message and each type of fault message; and classifying each type of maintenance message with respect to its ability to predict a fault with a classification selected from the group consisting of trigger, precursor, both trigger and precursor, and neither trigger nor precursor.

* * * * *